US006670773B2

(12) United States Patent
Nakamura et al.

(10) Patent No.: US 6,670,773 B2
(45) Date of Patent: Dec. 30, 2003

(54) DRIVE CIRCUIT FOR ACTIVE MATRIX LIGHT EMITTING DEVICE

(75) Inventors: Hiroyuki Nakamura, Atsugi (JP); Shigeki Kondo, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/247,284

(22) Filed: Sep. 20, 2002

(65) Prior Publication Data

US 2003/0178946 A1 Sep. 25, 2003

Related U.S. Application Data

(63) Continuation of application No. PCT/JP02/02592, filed on Mar. 19, 2002.

(30) Foreign Application Priority Data

Mar. 21, 2001 (JP) ..... 2001-080504

(51) Int. Cl.[7] ..... G09G 3/10

(52) U.S. Cl. ..... 315/169.3; 345/211; 345/55; 345/82; 345/92

(58) Field of Search ..... 315/169.3, 170; 345/206, 211, 214, 45, 46, 55, 76, 82, 92

(56) References Cited

U.S. PATENT DOCUMENTS

| | | | | |
|---|---|---|---|---|
| 5,006,732 A | | 4/1991 | Nakamura | 307/473 |
| 5,594,463 A | | 1/1997 | Sakamoto | 345/76 |
| 5,714,968 A | * | 2/1998 | Ikeda | 345/77 |
| 5,940,053 A | * | 8/1999 | Ikeda | 345/77 |
| 6,424,326 B2 | * | 7/2002 | Yamazaki et al. | 345/77 |

FOREIGN PATENT DOCUMENTS

| | | |
|---|---|---|
| EP | 0 365 445 A2 | 4/1990 |
| JP | 5-265399 | 10/1993 |
| JP | 8-54835 | 2/1996 |
| WO | WO 98/48403 | 10/1998 |

OTHER PUBLICATIONS

"Low–Temperature Poly–Si TFT Display Using Light–Emitting–Polymer," M. Kimura, et al., AM–LCD 2000, AM3–1, pp. 245–248, 2000.

"Late–News Paper: 4.0–in. TFT–OLED Displays and a Novel Digital Driving Method," K. Inukal, et al., 2000 SID 36.4L, pp. 924–927, 2000.

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

The invention intends to improve the gradation and the image quality in a display apparatus based on a current-controlled light emission device, represented by the organic EL device.

There is provided a circuit configuration in which switch means is provided parallel to the light-emitting element, and a current path is provided by a change in the conductances of the switch means and the light-emitting element to control the light-emitting and non-emitting states of the light-emitting element. The circuit configuration enables gradational display by an analog change in the conductance, and time gradation display by controlling the light-emitting time.

9 Claims, 4 Drawing Sheets

DRIVE CIRCUIT FOR ACTIVE MATRIX LIGHT EMITTING DEVICE

This application is a continuation of International Application No. PCT/JP02/02592, filed Mar. 19, 2002, which claims the benefit of Japanese Patent Application No. 080504/2001,filed Mar. 21, 2001.

BACKGROUND OF THE INVENTION

1. Field of the Invention

The present invention relates to a drive circuit for a light emitting device for use in an image display apparatus, more particularly to a drive circuit for a light emitting device of active matrix type for driving a light-emitting device such as an organic or inorganic electroluminescent (hereinafter called "EL")device or a light-emitting diode (hereinafter called "LED"), and a display panel of active matrix type utilizing such drive circuit.

2. Related Background Art

A display utilizing light-emitting devices such as organic or inorganic EL devices or LEDs arranged in an array and displaying a character by a dot matrix method is widely utilized in television, portable information terminal etc.

Such display based on the light-emitting device is currently interested because of the features, in comparison with the display utilizing liquid crystal, of the absence of a light source for illumination from the rear and a wider viewing angle. In particular, the display of so-called active matrix type, in which a static drive is executed by the combination of transistors and the aforementioned light-emitting devices, is currently attracting attention because of advantages of a higher luminance, a higher contrast and a higher definition, in comparison with the display of simple matrix drive based on time-shared drive.

Also for providing an image with gradation in the organic EL device, there can be conceived an analog gradation method, an area gradation method and a time gradation method as already known in the prior art:

(1) Analog Method

As an example of the conventional configuration, a simplest display device utilizing two thin film transistors (hereinafter called "TFT")per pixel is shown in FIGS. 6 and 7. In FIG. 6, there are shown an organic EL element 101, TFTs 102, 103, a scanning line 107, a signal line 108, a power supply line 109, a ground potential 110, and a memory capacity 111 utilizing a capacitor.

The circuit shown in FIG. 6 functions in the following manner. When TFT 102 is turned on by the scanning line 107, an image data voltage from the signal line 108 is accumulated in the memory capacity 111. When the scanning line 107 is turned off to turn off TFT 102, the above-mentioned voltage continues to be applied to the gate of TFT 103 whereby TFT 103 remains in the turned-on state.

On the other hand, the source electrode of TFT 103 is connected to the power supply line 109, while the drain electrode is connected to one of the electrodes of the light-emitting element, and the gate electrode receives the image data voltage at the drain electrode of TFT 102, whereby the current between the source electrode and the drain electrode is controlled by the above-mentioned image data voltage. The organic EL element, being connected between the power supply line 109 and the ground potential, emits light corresponding to the aforementioned current.

Since the amount of current depends on the gate potential of TFT 103, the light emission intensity is regulated by changing the current characteristics in analog manner, utilizing an area (saturation area) where the source current as a function of the gate potential (Vg-Is characteristics) shows an upshift.

As a result, the light emission intensity of the organic EL element can be controlled and the display involving gradation can be realized. Such gradation representing method, utilizing an analog image data voltage, is called analog gradation method. In such method, the image data signal has to be adjusted in the gamma ($\gamma$) characteristics according to the voltage-luminance characteristics of the organic EL element.

It is advantageous also for the light-emitting device, as in the liquid crystal display device or in the CRT, to enable gradational display by varying the light emission intensity of each pixel in order to achieve moving image display for the monitor of the personal computer or the television and also in order to ensure compatibility with the CRT. Also there will be obtained an advantage in cost, because of simplification in the driving system.

The aforementioned TFT currently includes that of amorphous silicon (a-Si) type and that of polycrystalline silicon (p-Si) type, but the latter is becoming more popularly employed because it shows a higher charge mobility enabling a finer configuration of the element and also because the progress in the laser working technology enables to execute the manufacturing process at a lower temperature. However, the polycrystalline silicon TFT is often influenced by the crystal grain boundary constituting the element, and tends to show a significant fluctuation from element to element in the Vg-Is current characteristics in the aforementioned saturation area. Therefore, such display device is-associated with a drawback of showing unevenness in the display, even if the video signal voltage entered into the pixels is uniform.

Also, the present TFT is mostly used as a switching element in an area where the drain voltage becomes constant as a function of the source voltage (such area being called a linear area) under the application of a gate potential considerably higher than the threshold voltage of the transistor, so that the aforementioned fluctuation in the saturation area is not much experienced.

(2) Area Gradation Method

On the other hand, an area gradation method is proposed in the reference AM-LCD2000, AM3-1. In this method, each pixel is divided into plural sub-pixels, each of which is on-off controlled to represent the gradation by the area of turned-on sub-pixels in the pixel.

In such method, the TFT can be utilized in the aforementioned linear area where the drain voltage becomes constant as a function of the source voltage, under the application of a gate potential much higher than the threshold voltage, so that the TFT can be used in a stable range of the characteristics and the light emission intensity of the light-emitting element is also stabilized. In such area gradation method, each element is on-off controlled and emits light at a constant intensity without gradational change, and the gradation is controlled by the area of the light-emitting sub pixels.

In this method, however, there can only be obtained digital gradation levels depending on the method of division of the sub pixels, and, in order to increase the number of gradation levels, it is required to increase the number of sub pixels with a reduction in the area thereof. However, even if the transistors are made smaller with the use of polycrystalline silicon TFTs, the area of the transistor portion in each pixel erodes the light-emitting area, thereby lowering the aperture rate of each pixel and reducing the light emission intensity of the display panel. Thus the luminance the gradational performance are in a trade-off relationship in which an increase in the aperture rate results in a decrease in the gradational performance, whereby it is difficult to improve the gradational performance.

(3) Time Gradation Method

In a time gradation method controls the gradation by the light-emitting time of an organic EL element, as reported in 2000SID36.4L.

FIG. 7 is a circuit diagram showing an example of a pixel portion of a conventional display panel employing the time gradation method. In FIG. 7 there are shown an organic EL element 101, TFTs 102 to 104, a scanning line 107, a signal line 108, a power supply line 109, a ground potential 110, a memory capacity 111 and a reset line 112.

In the time gradation method utilizing such circuit configuration, when TFT 103 is turned on, the organic EL element 101 emits light at the maximum intensity by the voltage from the signal line, while TFT 103 repeats on and off within a field time by TFT 104 and the gradation is represented by such light-emitting time.

Also in this method, the light-emitting time is regulated by selecting one of plural light-emitting periods. For example, in case of gradational display of 8 bits (256 levels), the light emitting time is selected from 8 sub-field periods having a ratio of 1:2:4:8:16:32:64:128. Immediately before each sub-field period, there is provided an addressing period for the scanning lines of all the pixels, for selecting the emitting or non-emitting state in such sub-field period. After such addressing period, the voltage of the power supply lines 109 is changed simultaneously to cause light emission over the entire display panel.

Consequently, since the addressing period is basically not used for display, the effective light-emitting period within a field, in case of N-bit gradational display, is given by:

effective light-emitting period=(a field period) −(addressing period×N in an image).

Therefore the light-emitting time becomes short in relative manner and results in a decrease in the light emission intensity of the display panel for the observer.

For this reason it becomes necessary to compensate the light emission amount in the entire field by increasing the light emission amount in each sub field, but such increase necessitates an increase in the light emission intensity of each light-emitting element, leading eventually to a reduction in the service life thereof. Also in comparison with the ordinary liquid crystal display (LCD) which requires only one addressing operation per field, there are required addressing operations corresponding to the number of bits of gradational levels, so that an addressing circuit of a higher speed is required and an increase in the electric power consumption is unavoidable.

SUMMARY OF THE INVENTION

The object of the present invention is to improve the conventional technologies explained in the foregoing, to provide a novel circuit configuration of the pixel transistors for a novel active matrix light-emitting device, and to provide a display panel superior to that of the conventional art.

A principal feature of the present invention resides in a circuit configuration of the light-emitting element of active matrix type in which a switching element is provided electrically parallel to the light-emitting element.

A second feature of the present invention resides in a circuit configuration of the light-emitting element of active matrix type in which a second switching element is provided at a side, closer to a constant current source, of the aforementioned light-emitting element.

The above-mentioned object can be attained, according to the present invention, by a drive circuit for a light-emitting device of active matrix type having a scanning line and a signal line in a matrix arrangement on a substrate and also having at least a light-emitting element in the vicinity of the crossing point of the scanning line and the signal line, the drive circuit comprising a constant current source connected to a driving electric power source, a light-emitting element provided serially to the constant current source, and a first switching element provided serially to the constant current source and electrically parallel to the light-emitting element.

In a preferred embodiment of the drive circuit of the present invention, the aforementioned first switching element is a first thin film transistor comprised of three electrodes of a source electrode, a drain electrode and a gate electrode.

Also, the drive circuit of the present invention includes as a preferred embodiment thereof a memory circuit capable of accumulating the image data signal. More specifically, the drive circuit of the present invention as a preferred embodiment comprises a memory circuit comprised of a second thin film transistor which has a gate electrode connected to the scanning line, a source electrode connected to the signal line, and a drain electrode, and a first memory capacitance.

Also, a preferred embodiment of the drive circuit of the present invention executes on-off control utilizing the aforementioned configuration of the drive circuit. More specifically, the drive circuit of the present invention in a preferred embodiment thereof executes on-off control of the light-emitting element by controlling the current in the aforementioned first switching element and the current amount in the aforementioned light-emitting element according to the information from the scanning line and the signal line.

The present invention further includes a preferred embodiment in which the aforementioned configuration of the drive circuit is utilized for gradational display. For this purpose, there may be employed the time gradation method or the analog gradation method. More specifically, the drive circuit of the present invention, in a preferred embodiment thereof, executes gradational display by controlling the light-emitting time, and, in another preferred embodiment, controls the light emission intensity of the aforementioned light-emitting element by controlling the current amount in the aforementioned first switching element and the current amount in the light-emitting element, according to the information from the scanning line and the signal line.

The preferred embodiment of the present invention further includes an improvement on the aforementioned configuration of the drive circuit. More specifically, the drive circuit of the present invention is preferably provided with a second switching element between the second electrode of the aforementioned light-emitting element and the aforementioned constant current source, and is more preferably adapted to execute on-off control of the light-emitting element by the switching operation of the second switching element. There is further preferred a configuration in which the second switching element is a third thin film transistor comprised of three electrodes, namely a source electrode, a drain electrode and a gate electrode. Also the drive circuit of the present invention, provided with the aforementioned second switching element, is preferably provided with a second memory circuit comprised of a fourth thin film transistor and a second memory capacitance, in which the output of such memory circuit is connected to the gate electrode of the aforementioned third thin film transistor.

DESCRIPTION OF THE PREFERRED EMBODIMENTS

The principal feature of the present invention resides in the novel drive circuit configuration for a light emitting device of active matrix type, in which a switching element is connected electrically parallel to a light-emitting element.

In such configuration, the on-off state of the first switching means is controlled according to the information from the scanning line and the signal line, and the light-emitting element can emit light when the first switching means is in an off state or while a current is given also the light-emitting element by current distribution. In the following, the present invention will be further clarified by specific embodiments thereof, but the present invention is by no means limited by such embodiments.

Figure 1:
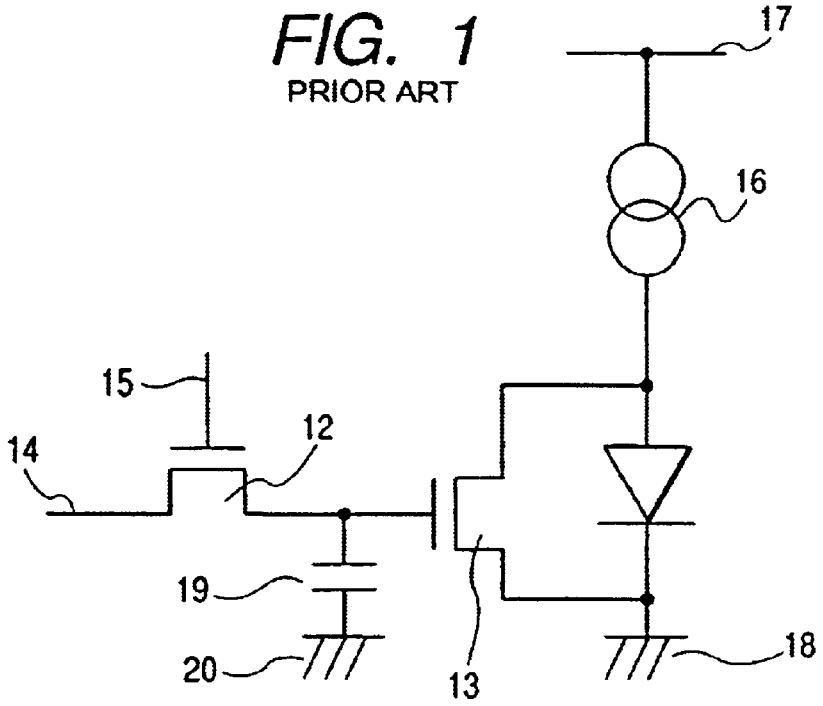
FIG. 1 PRIOR ART
FIG. 1 is a circuit diagram showing a pixel portion of a prior art display panel.

FIG. 1 is a circuit diagram of a pixel portion of the light emitting device of the present invention.

In FIG. 1, there are shown an organic EL element constituting the light-emitting element 11, TFTs 12, 13 respectively constituting the first and second switching means of the present invention, a constant current source 16, a scanning line 15, an image data signal line 14, a power supply line 17, a first power source 18 (at ground potential in the illustration), a memory capacitance 19, and a second power source 20 (at ground potential GND in the illustration).

In the present circuit, the light-emitting element 11 is constantly connected to the power supply line 17, which is connected to a driving power source (not shown), the constant current source 16 connected thereto and the first power source 18. The current between the constant current source and the ground potential is distributed depending on the conductances of the light-emitting element and TFT 13 constituting the first switching means, whereby the light-emitting element emits light of a predetermined intensity according to the amount of such current.

When an image data signal is entered into the gate electrode of TFT 12, TFT 13 is turned on and a charge is simultaneously accumulated in the memory capacitance 19 to induce a current in TFT 13.

Thereby the current from the constant current source flows through TFT. 13 but does not flow through the light-emitting element, which is thus placed in a light non-emitting state.

In the foregoing, the first power source 18 and the second power source 20 are both at the ground potential, but they may also independently assume other potentials.

In this manner, the light-emitting element can be turned on and off by adjusting the conductances for the currents in the light-emitting element and the switching element. The magnitude of the image data signal is so selected as to turn off TFT 13 for turning on the light-emitting element and to turn on TFT 13 for obtaining the light non-emitting state of the light-emitting element.

Therefore, the magnitude of the image data signal has to be inverse to the light emission intensity of the light-emitting element, and an inverse gamma ($\gamma$) correction has to be executed by a correction circuit for generating the image data signal.

Consequently it is required to newly provide a correction circuit for the image data signal. Also the current from the constant current source always flows either through the light-emitting element 11 or TFT 13, so that a constant electric current is always required from the constant current source, leading to the drawback an increased electric current consumption, in comparison with the conventional light emitting device which does not require electric power consumption in the light non-emitting state.

On the other hand, the drive circuit of the present embodiment is superior in the response speed of the light emitting device to the image data signal, since, in case of repeating the on-off operations rapidly, there is required a certain transient time until the current is stabilized even for a constant current source and the desired light emission intensity cannot be obtained during such transient time. Also the drive circuit of the present embodiment is superior in the stability of current as the constant current source continuously provides a constant current.

On the other hand, in case of turning on the light-emitting element, TFT 13 desirably has a resistance as high as possible, in comparison with the conductance of the light-emitting element. Also in case of turning off the light-emitting element, it is necessary to gather the current in TFT 13, ideally with a zero current in the light-emitting elements, and in practice TFT 13 is required to have such a low resistance as to provide the light-emitting element with a current less than the light emission threshold value.

Now, let us consider, as an example of digital gradation method currently employed in the computer or the like, a gradation display of 256 density levels in each light-emitting element. If the light emitting time is constant, the light emission intensity is proportional to the current in the element, so that, assuming that the current corresponding to the maximum light emission intensity is 1, the current corresponding to the minimum light emission intensity is 1/256. Therefore, it is required to control the conductance of the TFT so as to allow only a current smaller than the above-mentioned value flow in the element in the non-emitting state. Even if the current in the light non-emitting state is selected at 1/5 of the current corresponding to the minimum light emission intensity, it is enough to achieve an on-off ratio of TFT 13 at about 1:1000 or only about 3 digits.

In view of only the above on-off ratio, such requirement for the on-off ratio in the characteristics of TFT 13 is much less severe, in consideration that the on-off ratio of 4 to 6 digits is required in the ordinary polycrystalline silicon TFTs. Such requirement may be met by the recently developed TFT based on the organic semiconductor, and the configuration of the present drive circuit can be considered advantageous in this regard.

Figure 2:
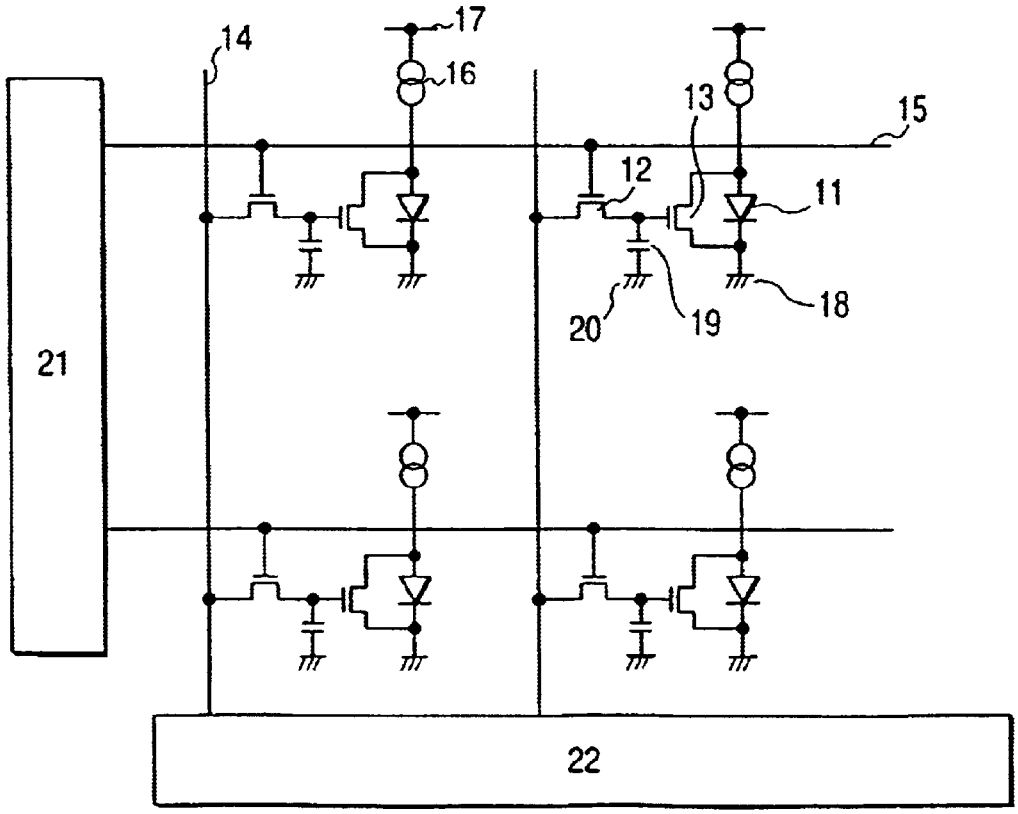
FIG. 2 PRIOR ART
FIG. 2 is a circuit diagram showing the matrix arrangement of a display panel having the pixel configuration shown in FIG. 1.

FIG. 2 is a circuit diagram of a light emission panel in which the light emitting devices of the configuration shown in FIG. 1 are provided in a matrix arrangement, wherein components same as those in FIG. 1 are represented by same numbers.

When a scanning control circuit 21 provides a scanning line 15 with a scanning line selection signal, a scanning line selection voltage is applied to the gate electrode of TFT 12, thereby turning on TFT 12. At the same time, an image data signal subjected to the aforementioned inverse γ correction is supplied from an image data control circuit 22 to the source electrode of TFT 12 through a signal line 14, whereby the image data signal is accumulated in a memory capacitance 19 formed of a capacitor provided between the drain electrode of TFT 12 and the second power source (ground potential) 20. While such voltage is retained, the image data signal voltage is applied to the gate electrode of TFT 13, thereby the light-emitting element 11 is caused to execute light emission.

In the foregoing there has been explained a general case where the first power source 18 and the second power source are both at the ground potential, but they may naturally be at different potentials. However, in case of employing such different potentials, a separate power supply line is required in the matrix wiring, complicating the preparation of the light emitting panel.

Figure 3:
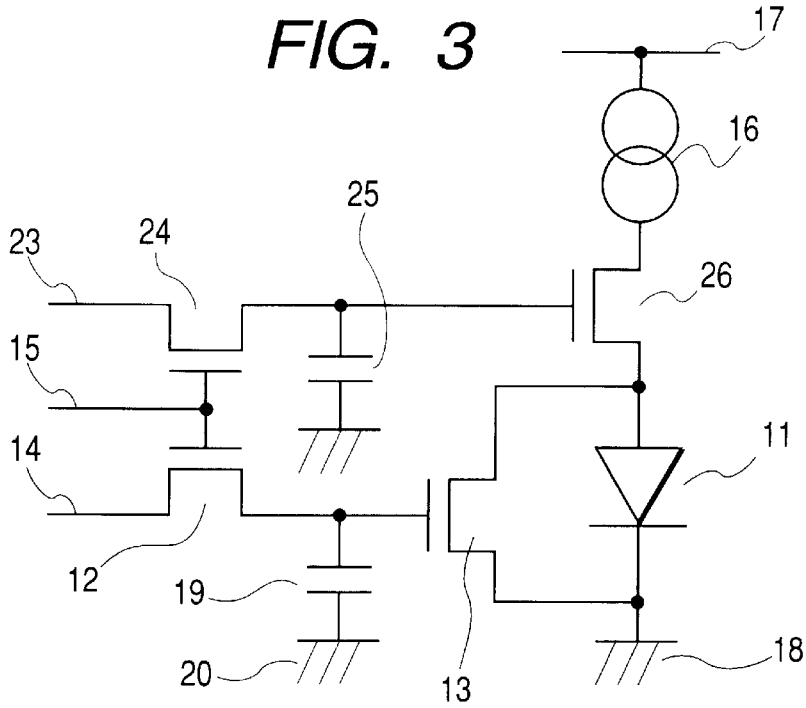
FIG. 3 is a circuit diagram showing a pixel portion of another embodiment of the present invention.

FIG. 3 shows the configuration of another embodiment of the. present invention, wherein components like those in FIG. 1 are represented by like numbers.

The configuration shown in the figure is different from that in FIG. 1 in that a third TFT 26 is provided between the constant current source 16 and the light-emitting element 11 and there is added a memory circuit comprised of a fourth TFT 24 and a second memory capacitance 25. The function of the present circuit configuration will be explained in the following.

At first, a scanning line selection signal is entered from the scanning line 15 to the 2nd TFT 12 and the 4th TFT 24. In this state, a low-level voltage constituting a light emission signal for the light-emitting element is applied to the signal line 14 and is accumulated in the memory capacitance 19 to turn off TFT 13. Thus, the conductance in the light-emitting element connected in parallel becomes smaller.

On the other hand, a high-level signal voltage is supplied to a reset line 23 for turning on the 3rd TFT 26, and is accumulated and retained in the memory capacitance 25.

Under this condition, the current from the constant current source flows into the light-emitting element, thereby providing a predetermined light emission intensity according to the conductances of TFT 13 and the light-emitting element.

On the other hand, when a high-level signal voltage is applied to the signal line to shift TFT 13 to a low-resistance (on) state, the light-emitting element has no current therein and does not emit light regardless whether TFT 26 is turned on or off. Also the light-emitting element can be turned off regardless of the state of TFT 13, since the current from the constant current source can be cut off by only turning off TFT 26.

As explained. in the foregoing, the above-described circuit configuration is also capable of on-off control of the light-emitting element. Also the gradational display can be achieved by controlling the conductance of TFT 13 and the light-emitting element, in a similar manner as in the case of FIG. 1.

Figure 4:
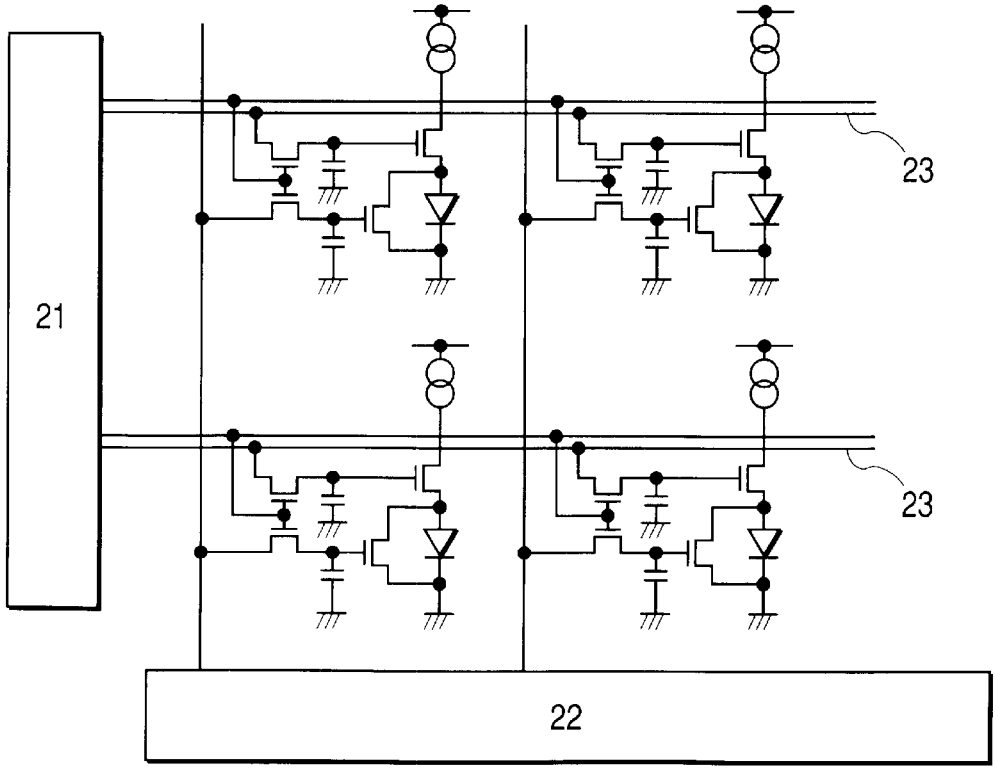
FIG. 4 is a circuit diagram showing the matrix arrangement of a display panel having the pixel configuration shown in FIG. 3.

FIG. 4 is a circuit diagram in which the circuit configuration shown in FIG. 3 is applied to a matrix panel.

It is furthermore possible to achieve time gradation display by on-off control of TFT 26. Such function will be explained in the following, with reference to FIGS. 3, 4 and 5.

Figure 5:
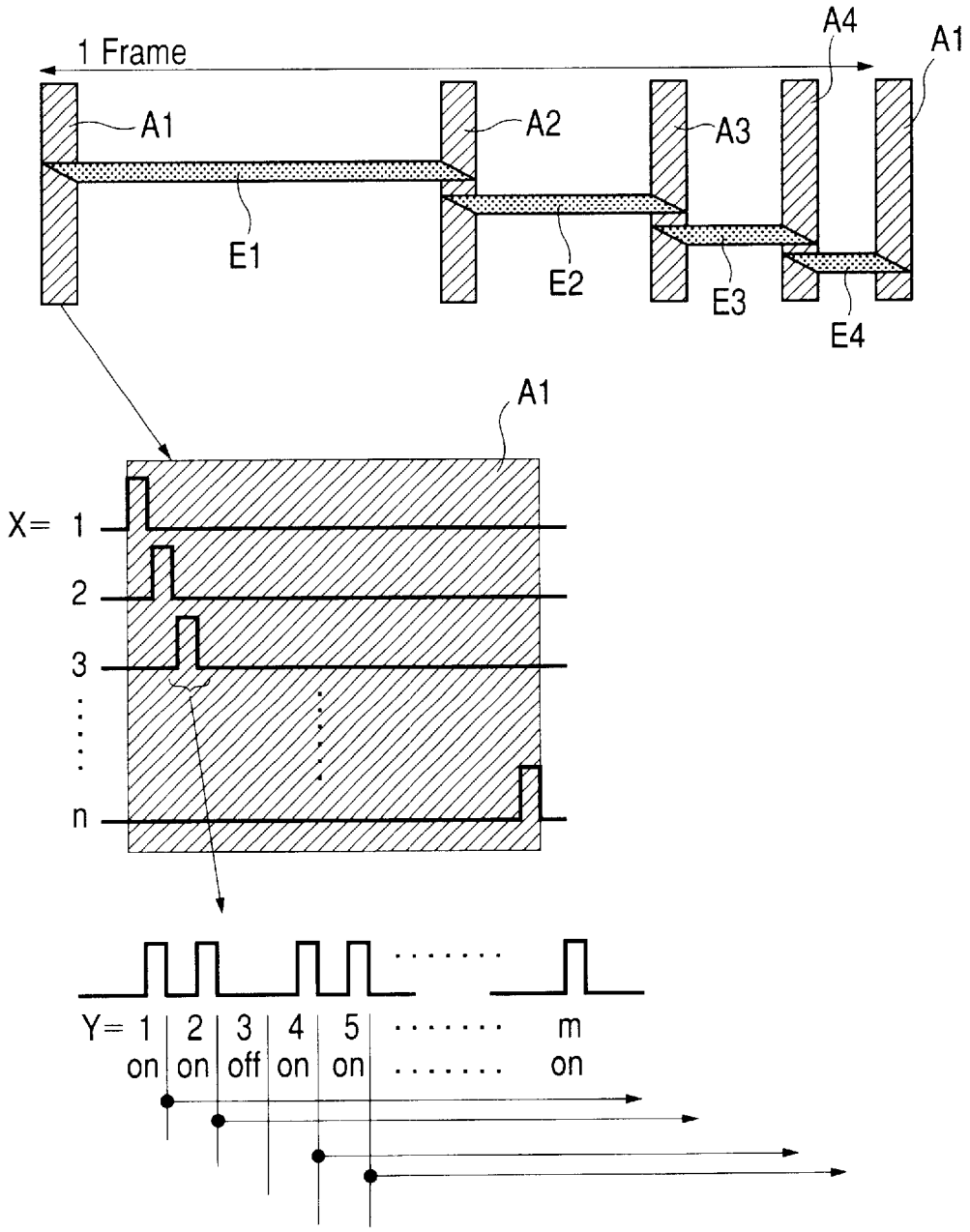
FIG. 5 is a timing chart of a time gradation display executed in a display panel having the drive circuit of the present invention.
Figure 6:
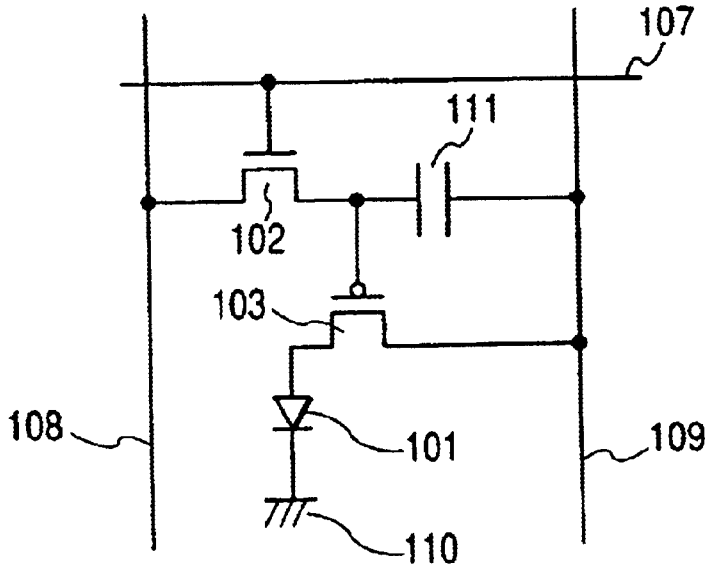
FIG. 6 PRIOR ART
FIG. 6 is a circuit diagram showing a pixel portion of a conventional active matrix light emission device.
Figure 7:
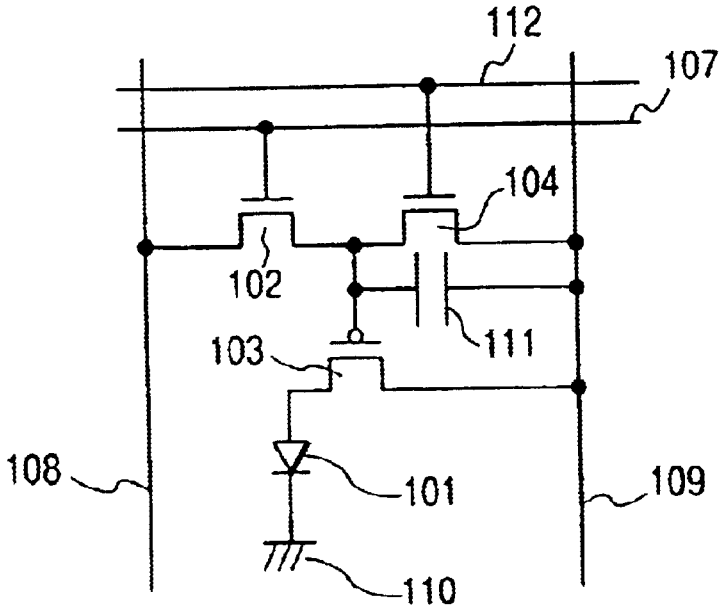
FIG. 7 PRIOR ART
FIG. 7 is a circuit diagram showing a pixel portion of another embodiment of the conventional active matrix light emitting device.

FIG. 5 is a timing chart of time gradation display by controlling the light-emitting time within a frame period by. means of the light emitting device having the drive circuit of the present invention.

Referring to FIG. 5, A1 to A4 respectively indicate addressing periods of sub fields. In a period A1, scanning signals are applied in succession to the scanning lines X=1 to n in the matrix arrangement. During each of such scanning periods, on-off signals for the pixels Y=1 to m are applied in succession from the signal line, thereby initiating light emission from each pixel. E1 to E4 indicate light-emitting periods of the respective sub fields, called PWM controlled light emission periods.

In the illustrated example, the turn-on time within one frame period is classified into sub field periods of lengths of ½, ¼, ⅛ and 1/16, and it is controlled whether the element is turned on in a specific period. For example, in case of obtaining a light emission intensity of ½ in a pixel, such a pixel is to be turned on only in a sub field period having a selection time (address period) of the length of 8.

When a scanning selection signal is entered into the scanning line 15 in FIG. 3 during the address period shown in FIG. 5, TFTs 12 and 24 are turned on and this state is retained by memory capacitances 19 and 25 for a specific period. The turn-on period of TFT 24 corresponds to the address period, which determines an information of the sub field. In such state, the image data control circuit 22 supplies a low-level voltage (light emission signal) or a high-level voltage (non-emitting signal) to each of signal lines 14 starting from the left-end side of the light emission panel, for example, thereby determining the state of TFT 13 in each pixel is decided. Immediately thereafter, each light-emitting element receiving the light emission signal begins to emit light.

Then, in a next sub field period, a next reset voltage is supplied to TFT 24 by the reset line, and a light emission signal or a non-emission signal is simultaneously supplied to each signal line in the same manner as in the preceding sub field period, whereby the state is retained during the next sub field period.

In the first address period within a frame corresponding to the selection of a scanning line of the above-mentioned example, an ON signal is out put from the image data control circuit 22 to the signal line 14 to turn on the light-emitting element for a period of a length of ½ (corresponding to ½ of a time of a frame). The light-emitting element is turned off in address periods corresponding to the remaining period, whereby the observer can observe the light emission intensity of 50%.

In the foregoing, the on-off control has been explained in the drive circuit shown in FIG. 3. Similar control can also be achieved in the drive circuit shown in FIG. 1, by on-off control of TFT 13. As already explained in the foregoing, the time gradation display can be achieved by dividing one field period into plural sub fields and executing on-off control in each sub field period.

The configuration requires two scanning lines for each and is more complex than that shown in FIG. 1, but provides the following advantages. In the above-described example, the signals supplied to the image data signal lines 14 and 23 may be selected at a high level and a low level, whereby the signal transmissions in the light emission panel are less susceptible to noises and can ensure stable operation. Also a faster signal transmission is rendered possible, because the device can operate at a lower voltage with generally lower voltage levels in the lines.

The drive circuit of the present invention can also be utilized for obtaining density gradation, by regulating the light emission intensity in analog manner. Since the ratio of conductance of the light-emitting element between the on and off states is only in the order of three digits, it is possible to arbitrarily control the light emission intensity by preparing TFT 13 with a similar range of the conductance and equally controlling the conductances of the light-emitting element and TFT 13 in FIG. 1 to regulate the distribution of the current amount from the constant current source 16. For example, an equal distribution makes the light-emitting element to receive the ½ current to provide a light intensity corresponding to a 50% gradation level.

The above-mentioned characteristic requirement can be sufficiently met not only by the amorphous or polycrystalline silicon TFT but also by the recently developed organic TFT utilizing the organic semiconductors, and is therefore not dependent on the constituting materials of the TFT.

As explained in the foregoing, the present invention allows to provide a novel pixel circuit for the organic EL device, utilizing a fewer number of transistors within a pixel. It also enables, in the time gradation display, to elongate the light emission time, thereby improving the luminance of the light emission panel.

What is claimed is:

1. A drive circuit for a light emitting device of an active matrix type, having a scanning line and a signal line in a matrix arrangement on a substrate and at least a light-emitting element in the vicinity of the crossing point of said scanning line and said signal line, said drive circuit comprising:

a constant current source connected to a driving electric power source;

a second switching element provided serially to said constant current source;

a light-emitting element provided serially to said second switching element; and a first switching element provided serially to said constant current source and electrically in parallel to said light-emitting element.

2. A drive circuit for a light emitting device according to claim 1, wherein said first switching element is a thin film transistor comprising three electrodes which are a source electrode, a drain electrode and a gate electrode.

3. A drive circuit for a light emitting device according to claim 1, further comprising a memory circuit comprising a thin film transistor including a gate electrode connected to the scanning line, a source electrode connected to the signal line and a drain electrode and a memory capacitance.

4. A drive circuit for a light emitting device according to claim 1, wherein the current flowing in said first switching element and the current amount flowing in said light-emitting element are controlled according to information from the scanning line and the signal line, thereby controlling the on-off state of said light-emitting element.

5. A drive circuit for a light emitting device according to claim 1, wherein the light emitting time is controlled by the on-off control of said light-emitting element, thereby achieving gradational display.

6. A drive circuit for a light emitting device according to claim 1, wherein the current amount flowing in said first switching element and the current amount flowing in said light-emitting element are controlled according to information from the canning line and the signal line, thereby controlling the light emission intensity of said light-emitting element.

7. A drive circuit for a light emitting device according to claim 1, wherein said second switching element is switched to control the on-off state of the light-emitting element.

8. A drive circuit for a light emitting device according to claim 7, wherein said second switching element is a thin film transistor comprising three electrodes which are a source electrode, a drain electrode and a gate electrode.

9. A drive circuit for a light emitting device according to claim 8, further comprising a second memory circuit comprising a thin film transistor and a memory capacitance, wherein the output of said memory circuit is connected to the gate electrode of said thin film transistor.

* * * * *

UNITED STATES PATENT AND TRADEMARK OFFICE

CERTIFICATE OF CORRECTION

PATENT NO. : 6,670,773 B2
DATED : December 30, 2003
INVENTOR(S) : Hiroyuki Nakamura et al.

It is certified that error appears in the above-identified patent and that said Letters Patent is hereby corrected as shown below:

Column 2,
Line 33,"is-associated" should read -- is associated --.

Column 6,
Line 6, "TFT." should read -- TFT --.

Column 7,
Line 36, "the." should read -- the --.

Column 8,
Line 15, "by." should read -- by --.

Column 10,
Line 12, "canning" should read -- scanning --.

Signed and Sealed this

Eighteenth Day of January, 2005

JON W. DUDAS
*Director of the United States Patent and Trademark Office*